United States Patent [19]

Ott

[11] Patent Number: 4,528,803

[45] Date of Patent: Jul. 16, 1985

[54] MACHINE FOR THE FABRICATION, FILLING, AND SEALING OF PACKAGES

[75] Inventor: Horst Ott, Darmstadt, Fed. Rep. of Germany

[73] Assignee: Tetra Pak International AB, Lund, Sweden

[21] Appl. No.: 414,341

[22] PCT Filed: Dec. 12, 1981

[86] PCT No.: PCT/EP81/00194

§ 371 Date: Aug. 17, 1982

§ 102(e) Date: Aug. 17, 1982

[87] PCT Pub. No.: WO82/02032

PCT Pub. Date: Jun. 24, 1982

[30] Foreign Application Priority Data

Dec. 17, 1980 [BR] Brazil ..... 8008271

[51] Int. Cl.[3] ..... B65B 3/02

[52] U.S. Cl. ..... 53/563; 53/266 R; 53/379; 53/388; 493/164; 493/247

[58] Field of Search ..... 53/550, 564, 568, 570, 53/575, 266 R, 375, 378, 379, 388, 253, 279, 280, 462, 563; 493/164, 247

[56] References Cited

U.S. PATENT DOCUMENTS

| | | | |
|---|---|---|---|
| 2,229,864 | 1/1941 | Moore | 53/482 X |
| 2,548,251 | 4/1951 | Bergstein | 53/462 X |
| 3,026,663 | 3/1962 | Giraudi | 53/379 |
| 3,559,369 | 2/1971 | Buchner et al. | 53/563 |
| 3,918,236 | 11/1975 | Allen | 53/452 |
| 4,080,237 | 3/1978 | Deimel | 53/375 |

FOREIGN PATENT DOCUMENTS

| | | | |
|---|---|---|---|
| 0001015 | 3/1979 | European Pat. Off. . | |
| 1078928 | 3/1960 | Fed. Rep. of Germany | 53/378 |
| 1073930 | 6/1967 | United Kingdom | 53/563 |

*Primary Examiner*—John Sipos
*Assistant Examiner*—Donald R. Studebaker
*Attorney, Agent, or Firm*—Burns, Doane, Swecker & Mathis

[57] ABSTRACT

Blanks are produced from a continuous sheet (3) of material comprised of plastic-coated paper. Said blanks are conveyed on an expanding mandrel carousel (13) to a bottom weld flap forming station (17) and then transferred to a filling carousel (19). The packages which have been formed from the blanks are filled at a filling station (20) and sealed at a top seam welding station (23). A top weld flap forming station (26) and a top weld flap sealing station (29) are disposed on a top forming carousel which adjoins the filling carousel (19). The finished packages are discharged at a discharge station (30), to a discharge turntable (31). The machine may be used for manufacturing packages for liquids, e.g. milk or juices.

4 Claims, 9 Drawing Figures

MACHINE FOR THE FABRICATION, FILLING, AND SEALING OF PACKAGES

The invention relates to a machine for the fabrication, filling, and sealing of packages, whereby the outer medium of packages, comprised of a shaped and welded flexible sheet of material, is filled and sealed, said machine comprising an expanding mandrel carousel, and at least one filling carousel disposed thereafter in the flow of work, said filling carousel having a filling station and a top seam welding station.

Such machines are employed mostly for manufacturing containers for liquids such as, e.g., milk, juices, and the like. The sheet of material is a continuous sheet, which may be, e.g., paper coated with plastic, is drawn off from a supply roller. The individual package exteriors are fabricated from said sheet by cutting and welding it. Each package exterior is held on an expanding mandrel of an expanding mandrel carousel.

In a known machine of the type described initially above (U.S. Pat. No. 3,918,236), the package exteriors, having been thus shaped, and now open only at the top, are alternately transferred to two subsequent filling carousels, in each of which the package exteriors are filled at a filling station and welded at a top seam welding station.

When packages having a parallelepiped shape are produced, flaps or lugs (from the weld) are formed at the bottom and top of the package, respectively. In order to avoid disturbing these flaps or lugs (hereinafter called simply "flaps" or "weld flaps") when the filled packages are carried in a larger packing container, e.g. a cardboard shipping box, said flaps must be held flush against the outside of the packages or else must be cut off. They may be cut off only if the weld at the given location on the package exterior is constructed such that the cutting does not give rise to an opening. This entails additional welding which is relatively costly. Simply pressing down the bottom and top weld flaps does not suffice to bring them into the proper position for the subsequent packing into the packing container.

An object of the invention is thus to devise a machine of the type described initially above whereby the bottom and top weld flaps (of the package) are durably positioned against the outside of the package, and wherein the additional work stations necessary to accomplish this (durable positioning) are disposed on the machine in a manner which maximally conserves space, and are as simple as possible from a fabrication standpoint.

This object is achieved according to the invention in that a bottom flap forming station is disposed on the expanding mandrel carousel, the top seam welding station has welding dies which extend over the entire length of the top seam, and there is a top forming carousel located downstream of the filling carousel in the flow of work, which top forming carousel has a top flap forming station and a top flap sealing station.

The bottom and top flaps are preformed in the respective forming stations such that in the subsequent sealing station they can be sealed against the outside of the package by simple means employing pressure and heat. The preforming enables the residual forces acting on the sealing location to be kept very small, thus avoiding the danger that the seal will subsequently come apart, and at the same time lowering the requirements for the strength of the seal such that little seal strength is required.

The increased number of work stations is provided for in a manner which is very simple from a fabrication standpoint and also space-saving, namely in that the stations for forming and sealing the top flaps are located on a separate top forming carousel. In comparison to the option of providing a larger carousel with more work stations, the inventive arrangement has the advantage of better space utilization. Moreover, the arrangement is particularly simple from a fabrication standpoint, because basically the same component parts can be used The invention is described in more detail hereinafter, with the aid of an exemplary embodiment which is illustrated in the drawings.

Figure 1:
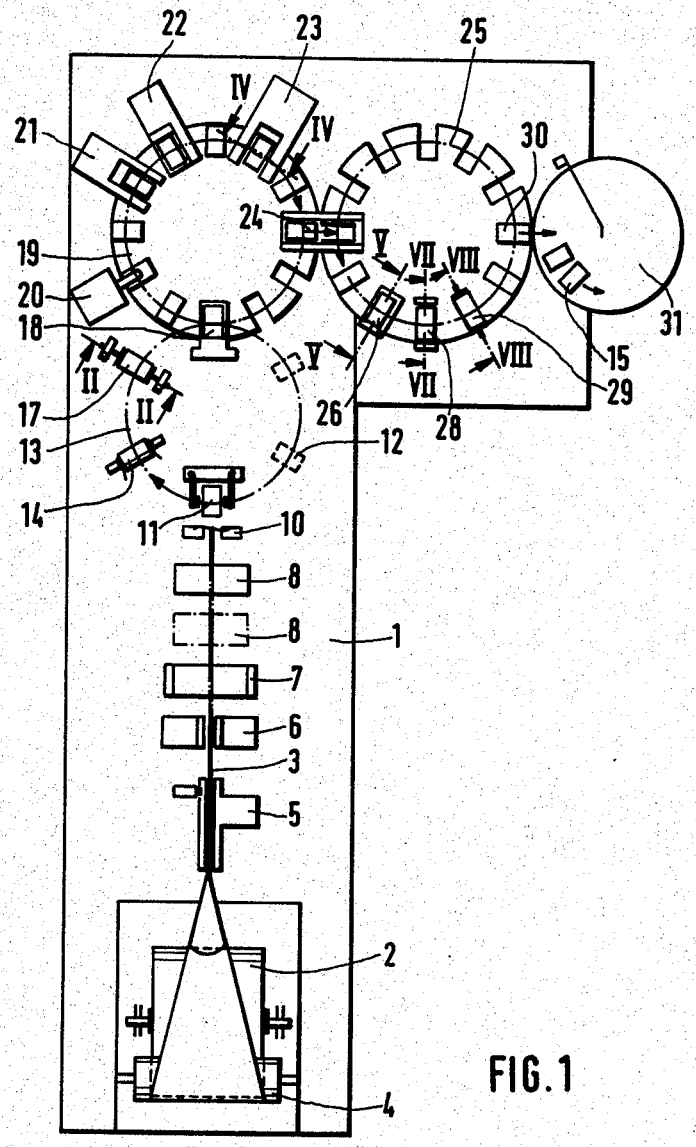
FIG. 1 is a simplified plan view of a machine for the fabrication, filling, and sealing of packages.

The machine for the fabrication, filling, and sealing of packages, which machine is shown in FIG. 1, comprises a supply roller 2 rotatably mounted on a machine frame 1, from which roller a flexible continuous sheet of material is drawn off. This sheet material may be e.g., plastic-coated paper. The material 3 first passes through a scoring station 4 where it is longitudinally scored and then folded together. The material strip 3 then passes in this configuration through a printer 5 which prints or impresses a date on it.

Then the material strip 3 passes through a stamping station 6, a longitudinal seam welding station 7 and a re-pressing and advancing station 8 where the longitudinal seam is re-pressed and in the same action the sheet is advanced. The cuts needed to fabricate a package exterior are made at a cutting station 10, yielding discrete blanks which are then pushed or loaded onto one of the expanding mandrels 12 of an expanding-mandrel carousel 13 (shown only in outline in the Figure), at a loading station 11.

The package blanks are moved clockwise to a folding station 14 at which the two side seams are formed. The folds which are formed by doubling over the sheet of material i.e., making a layered fold are located on the bottom of the package. At station 14 the bottom flaps 16 of package 15 (FIG. 2), which flaps originate when the package blank is loaded onto the expanding mandrel 12, are heated preparatory to being sealed at the bottom flap sealing station 17 (FIG. 3).

Figure 8:
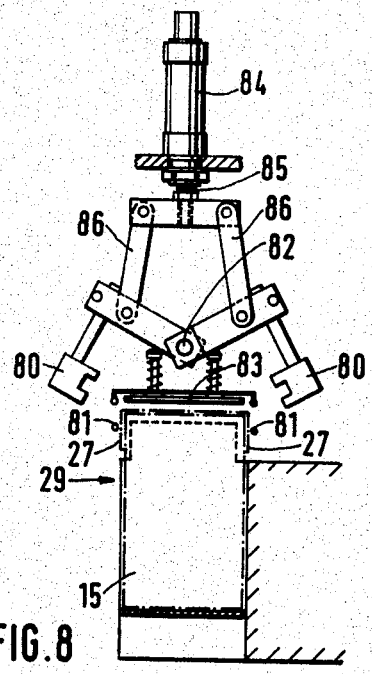
FIG. 8 is a magnified partial cross section, along the line VIII—VIII of FIG. 1, showing a top weld flap sealing station in its initial position.
Figure 9:
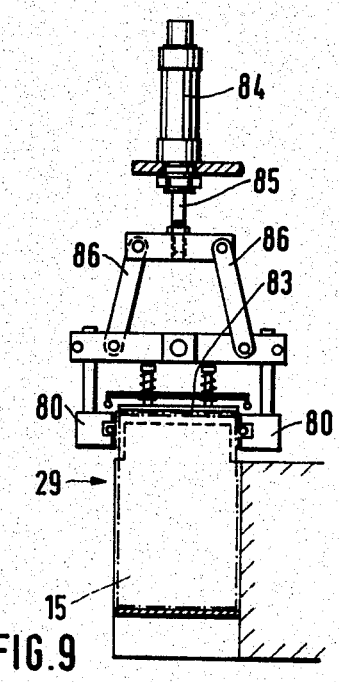
FIG. 9 is the top weld flap sealing station of FIG. 8, in its final position.
Figure 4:
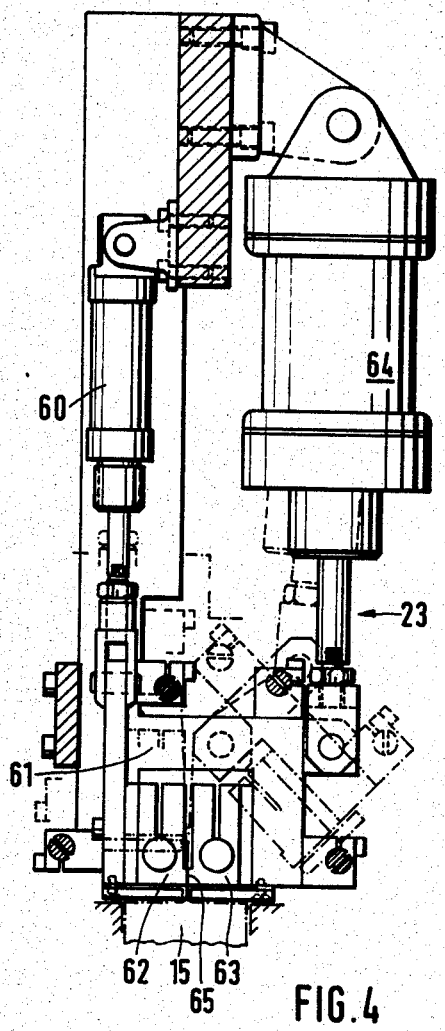
FIG. 4 is a magnified partial cross section, along the line IV—IV of FIG. 1, showing the top seam welding station in the welding position, with the initial position of the welding head shown by the dot-dashed lines.
Figure 5:
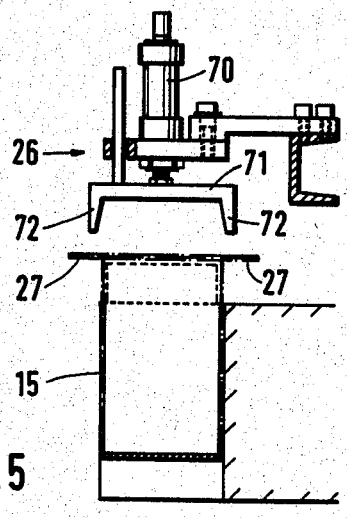
FIG. 5 is a magnified partial cross section, along the line V—V of FIG. 1, showing a top weld flap forming station in its initial position.
Figure 6:
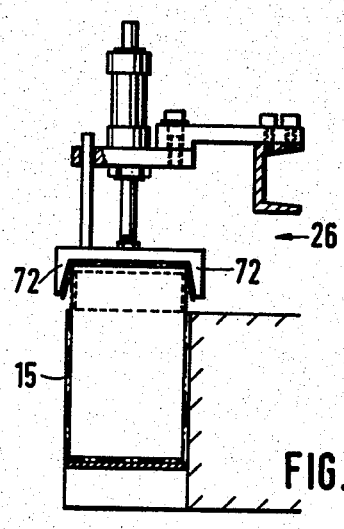
FIG. 6 is the top weld flap forming station of FIG. 5, in its final position.

At this point the package exterior (hereinafter, "the package") 15 is ready for filling. The package is transferred from the spreading mandrel carousel 13 to a filling carousel 19, in the process being removed from the expanding mandrel. The package 15 is filled at a filling station 20. The continuous top seam of the package 15 is spread apart at a top seam spreading station 21 by means of spreading fingers, and is preformed at a subsequent top seam forming station 22 to prepare it for welding at a top seam welding station 23 (FIG. 4). The closed package 15 is then transferred to a top forming carousel 25 at a transfer station 24, and is carried to a top flap forming station 26 (FIGS. 5 and 6) where the top flaps, which at that point still extend outward, are bent downward and thereby pre-formed. In a subsequent top flap heating station 28 (FIG. 27) the undersides of the top flaps 27 and the associated outside surfaces of the package are heated to enable said flaps to be sealed to said surfaces at a subsequent top flap sealing station 29 (FIGS. 8 and 9).

The finished packages 15 are moved to a discharge turntable 31 at a discharge station 30 from whence they are sent to be packed in larger packing containers.

The bottom flap forming station 17 (FIG. 2) has two press plates 40 which are moveable transversely and are connected to respective guide rollers 41. A hydraulic pressure cylinder 42 employing some pressure medium not necessarily liquid has a plunger 43 which carries a vertically moveable control body 44 to which side arms 45 are attached which terminate in respective inclined control surfaces 46 which engage the guide rollers 41.

At the respective lower ends of the press plates 40, hinged pieces for weld flap forming 48 are swingably attached by means of hinges 47. Each of the two said hinged pieces bears a guide roller 49 which engages curved control surfaces 50 on control body 44.

When the control body 44 is moved upward by the hydraulic cylinder 42, the press plates 40 move sideways against the package 15. At the same time the hinged flap-forming pieces 48 are swung into the final positions shown in FIG. 3.

Figure 2:
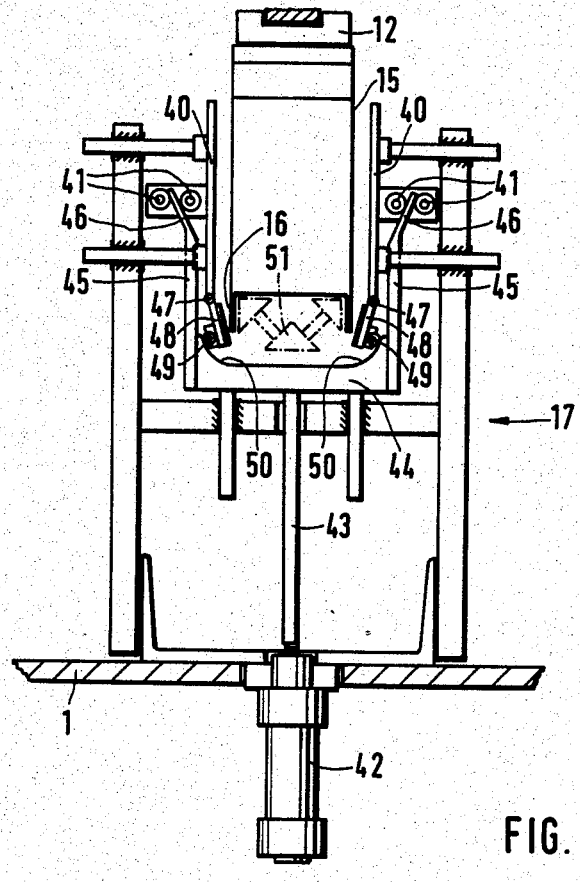
FIG. 2 is a magnified partial cross section, along the line II—II of FIG. 1, showing the bottom weld flap forming station in its initial position.
Figure 3:
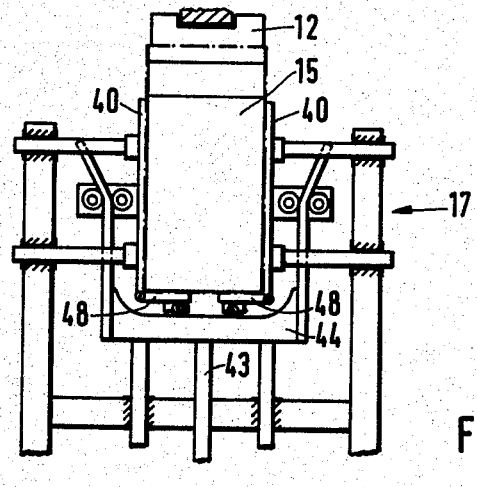
FIG. 3 is a partial cross section corresponding to that of FIG. 2, showing the bottom weld flap forming station in its final position.

In FIG. 2 a bottom flap heater 51 is shown with dot-dashed lines. This heater is disposed at the folding station 14 to heat the bottom flaps 16 and the associated outside surfaces of the package 15. These heated surfaces are then pressed together at the bottom flap forming station 17 (FIG. 3) to seal the bottom flaps 16 (in the pressed-together position). The press plates which rest against the side surfaces of the package During this sealing step prevent the side faces of the package from curving or buckling outward when the compressive force required for the sealing is applied to the bottom of the package.

The top seam welding station 23 (FIG. 4) has a welding head 61 which is moveable vertically by means of a hydraulic pressure cylinder 60. Welding head 61 comprises a fixed welding die 62 and a swingable welding die 63 swingably attached to said die 62. Both welding dies 62 and 63 can be heated. The swingable welding die 63 is operatively connected to a hydraulic pressure cylinder 64.

When the package 15 with its top weld seam 65 having been pre-formed at station 22 reaches the top seam welding station 23, the welding head 61 is in the initial swung-up position (shown in FIG. 4 with dot-dashed lines). The hydraulic cylinder 60 moves the welding head 61 downward. Then the hydraulic cylinder 64 closes the welding head and exerts the necessary welding force on the top seam 65, with heating in addition. The length of welding dies 62 and 63 is such that they extend over the entire length of the top seam 65, and thus the top seam is sealed completely in a single welding operation. The top seam thus extends up to the top weld flaps 27.

The transfer station 24 (not illustrated in detail) is constructed similarly to the top seam welding station 23, except that the dies 62 and 63 are not heated but are cooled. The top seam 65 is re-pressed here and hardened. The device (basic structure shown in FIG. 4) which holds the package at the top seam, at the transfer station 24, is moveable transversely to the circumference of the carousel and transports the package 15 from the filling carousel 19 to the top forming carousel 25.

The top forming station 26 (FIGS. 5 and 6) has a forming element 71 which is vertically moveable by a hydraulic cylinder 70 and which has top weld flap forming dies 72 extending down from the ends of its plate-shaped middle piece. When forming element 71 is lowered onto the package 15 (FIG. 6), the top flap forming dies 72 press the top weld flaps 27 down to pre-form said flaps.

Figure 7:
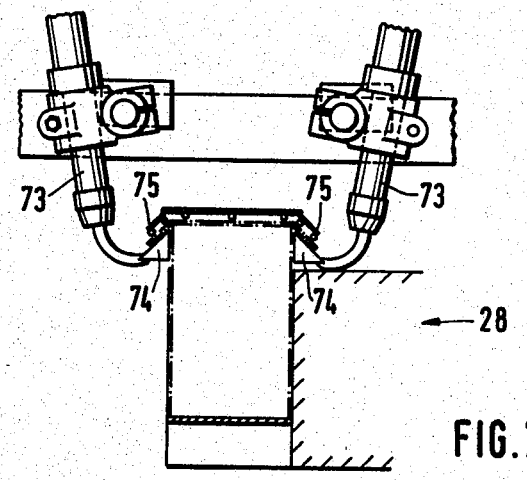
FIG. 7 is a partial cross section, along the line VII—VII of FIG. 1, of a top flap heating station.

At the subsequent top flap heating station 28 (FIG. 7), the heating nozzles 74 of hot air blowers 73 make contact with [sic–i.e., act on] the undersides of the top weld flaps 27 and heat them along with the corresponding opposing surfaces of the side walls of the package. During this process the top weld flaps 27 are held in place by guides 75.

In the next station, the top weld flap sealing station 29 (FIGS. 8 and 9), the thus heated surfaces or flap surfaces are pressed against the side walls of the package by flap sealing dies 80 capable of exerting sideways force, and in that position the flap surfaces are stably sealed. During this process and prior to the final sealing the top weld flaps are held in place by guide rods 81.

The side-positioned flap sealing dies 80 are connected to each other at a pivot 82, and are also connected to a vertically moveable top bracing plate 83. A hydraulic cylinder 84 is linked through its piston plunger 85 and link rods (guide rods) 86 to each of the flap sealing dies 80 respectively. When the plunger 85 is driven outward, first the top bracing plate 83 is pushed against the top side of the package 15 and then the flap sealing dies 80 come to press sideways against the top weld flaps 27. During this latter process the top bracing plate 83 prevents the top side of the package 15 from curving or buckling upward under the compressive force of the flap sealing dies 80.

I claim:

1. A machine for the fabrication, filling, and sealing of packages, whereby the outer medium of the packages, comprised of a shaped and welded, flexible sheet of material, is filled and sealed, said machine comprising an expanding mandrel carousel and at least one filling carousel positioned in the flow of work, said filling carousel having a filling station and a top seam welding station; further comprising a bottom flap forming station disposed on the expanding mandrel carousel provided with two press plates, swingably attached hinged pieces connected to said two press plates for weld flap forming; a vertically moveable control body including two control surfaces each or which produces a transverse movement of one of said two press plates, and said control body further including two curved control surfaces each of which engages one of said hinged pieces for weld flap forming and so as to cause said piece to execute a swinging motion; the top seam welding station provided with welding dies which extend over the entire length of the top seam; a top forming carousel located downstream of the filling carousel (19) in the flow of work, said top forming carousel provided with a top flap forming station and a top flap sealing station.

2. A machine according to claim 1; wherein the top seam welding station comprises a welding head moveable vertically by means of a hydraulic cylinder and which includes a fixed welding die and a swingable welding die swingably attached to said fixed die, both of which dies are heatable; the swingable welding die being operatively connected to a hydraulic pressure cylinder.

3. A machine according to claim 1; including a transfer station provided at the transfer point between the filling carousel and the top forming carousel, said station comprising a driveable transferring holding means comprised of a holding head which is vertically moveable by means of a hydraulic cylinder and which is comprised of a fixed jaw piece and a swingable jaw piece pivotably connected to said fixed jaw piece; said swingable jaw piece is operatively connected to a hydraulic cylinder.

4. A machine according to claim 1; wherein the top flap sealing station comprises a vertically moveable top bracing plate and two sideways operating flap sealing dies pivotably connected to each other through a pivot point and to said top bracing plate.

* * * * *